US006053141A

United States Patent [19]

Mutterer et al.

[11] Patent Number: 6,053,141

[45] Date of Patent: Apr. 25, 2000

[54] CYLINDER HEAD FOR INTERNAL-COMBUSTION ENGINES

[75] Inventors: Martin Mutterer, Leutenbach; Eckhart Nitzschke, Stuttgart; Tilmann Roemheld, Weinstadt; Willy Treyz, Neckartailfingen, all of Germany

[73] Assignee: DaimlerChrysler AG, Stuttgart, Germany

[21] Appl. No.: 08/996,209

[22] Filed: Dec. 22, 1997

[30] Foreign Application Priority Data

Dec. 21, 1996 [DE] Germany ..... 196 53 909

[51] Int. Cl.[7] ..... F02F 1/42

[52] U.S. Cl. ..... 123/193.5

[58] Field of Search ..... 123/193.5, 193.3, 123/193.1

[56] References Cited

U.S. PATENT DOCUMENTS

| | | | |
|---|---|---|---|
| 4,079,588 | 3/1978 | Yoshimura et al. | 123/193.5 |
| 4,508,066 | 4/1985 | Hartsock | 123/193.5 |
| 4,519,359 | 5/1985 | Dworak et al. | 123/193.5 |
| 5,816,210 | 10/1998 | Yamaguchi | 123/193.5 |

FOREIGN PATENT DOCUMENTS

| | | |
|---|---|---|
| 0 233 555 | 8/1987 | European Pat. Off. . |
| 0 275 841 | 7/1988 | European Pat. Off. . |
| 0 281 015 | 9/1988 | European Pat. Off. . |
| 36 03 582 | 3/1987 | Germany . |
| 40 40 948 | 2/1992 | Germany . |
| 195 02 342 | 8/1995 | Germany . |
| 62-157265 | 7/1987 | Japan . |
| 7 803 426 | 10/1978 | Netherlands . |

*Primary Examiner*—Marguerite McMahon
*Attorney, Agent, or Firm*—Evenson, McKeown, Edwards & Lenahan, P.L.L.C.

[57] ABSTRACT

A cast cylinder head for an internal-combustion engine, in which the charge cycle ducts have a fluctuating duct offset relative to the valve opening caused by the casting technique. Proximate the opening, the charge cycle ducts are provided with a machining allowance which increases toward the duct end and are machined there in a cutting manner so that the interior surface of the charge cycle ducts changes in each case without an offset into the valve opening. In order to achieve a simple tool guiding and nevertheless a machining which is advantageous to the flow, a compensating groove is arranged in the machining allowance of the charge cycle ducts which has a flat V-shaped cross-section and extends in the circumferential direction, specifically—relative to the flow direction—at least in the area of a convex course of the duct wall. The groove flanks have a convex cross-section and are curved to be as free of flow separations as possible. The compensating groove extends at a distance above the upper edge of the valve seat ring which corresponds to approximately 20 to 30% of the inside diameter of the valve opening. The groove base is situated outside the ideal course of the duct surface. The compensating groove extends at least approximately in a plane which is situated approximately at a right angle relative to the duct center line. The depth of the groove measured to the duct tangent corresponds approximately to the maximal core offset.

14 Claims, 3 Drawing Sheets

Fig. 5
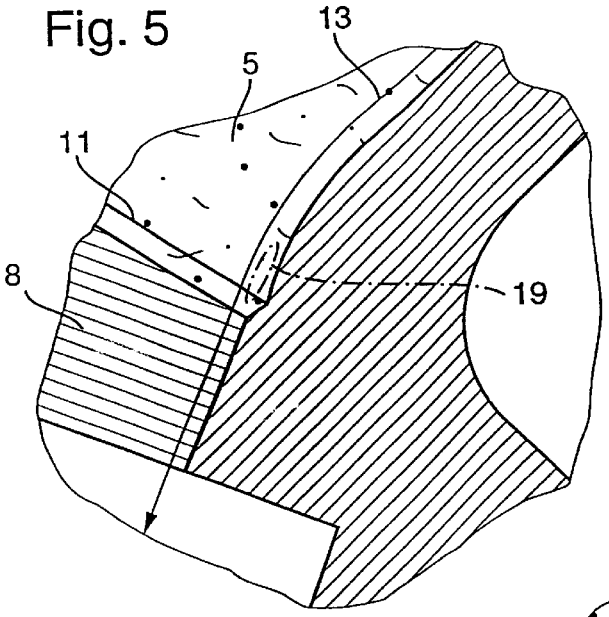
Fig. 6
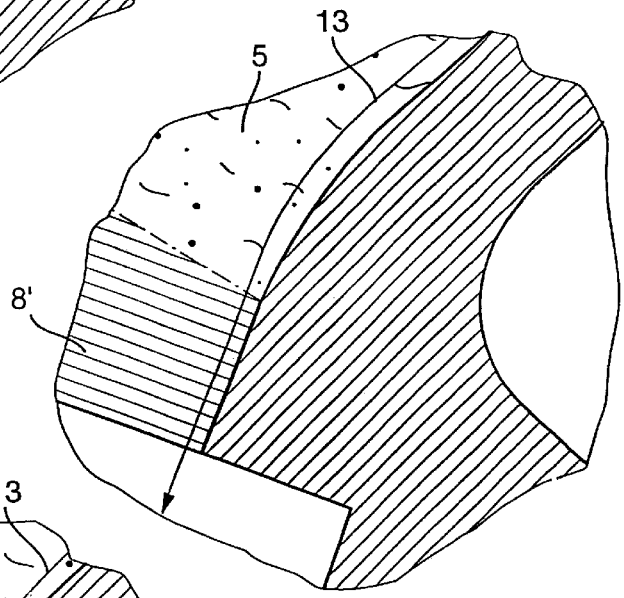
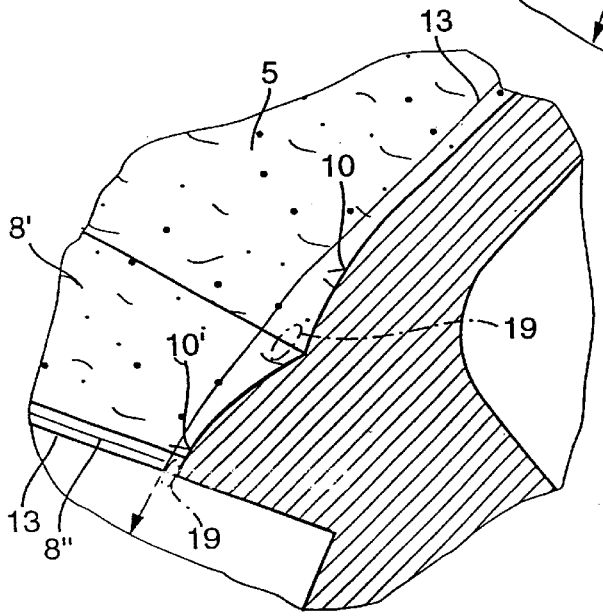
Fig. 7

CYLINDER HEAD FOR INTERNAL-COMBUSTION ENGINES

BACKGROUND AND SUMMARY OF THE INVENTION

This application claims the priority of German patent application 196 53 909.9, the disclosure of which is expressly incorporated by reference herein.

The invention is based on a cylinder head for internal-combustion engines, as known, for example, from German Patent Documents DE 36 03 582 C1 or DE 195 02 342 A1.

Cylinder heads for internal-combustion engines are components which have complicated shapes and are produced by casting. The casting cores for casting the interior surface of the charge cycle ducts have an unavoidable offset with respect to an ideal position of the core which fluctuates from one workpiece to the next. The desired position of the interior surface of the charge cycle valves is determined by the position of the respective pertaining valve opening in the combustion-space-side boundary wall of the cylinder head. Because of the core offset, a machining allowance, which increases toward the valve opening, was provided on the charge cycle ducts in the cast crude state in the area close to the opening, which machining allowance corresponds with respect to its amount on the valve opening at least to the maximally permissible offset amount. This results in a variation of the cutting depth of approximately twice the amount of the offset. This interior-side overmeasure of material will then be machined down such that the interior surface of the charge cycle ducts changes in each case without any offset into the valve opening.

For this purpose, the initially cited documents recommend a machining by means of a forming cutter, in which case the spatial desired contour of the charge cycle ducts is produced by a corresponding spatial guiding of a spherical cutter or disk milling cutter. Although, by means of such a machining, a transition of the interior surface of the duct into the valve opening can be produced which has no offset and is advantageous with respect to the flow, because of the spatial movement of the cutter, the required machining is complicated and, because of the low metal removing engagement of the forming cutter into the workpiece at the respective working point, is also very slow. The spatial guiding of the cutter can be carried out only by means of very expensive processing machines so that the machining results in high investment costs. Nevertheless, because of the long-lasting machining, the productivity is low. In addition, the use of more efficient, higher-stress-withstanding and exchangeable hard-metal blades in spherical or disk milling cutters is not possible at least in the case of the cutter sizes which are suitable in practice.

It is known to produce an offset-free transition of the valve opening into the charge cycle ducts in a cutting manner in that a forming cutter, which, in the vertical center, has the shape of a pointed arch and, in its diameter, corresponds to the inside diameter of the valve opening, is cuttingly dipped from the combustion space side in a straight line and concentrically into the valve opening, in which case the interior surface of the duct wall is also machined. Such a machining requires only a simple spindle movement similar to a drilling operation which can be carried out by a low-cost standard machine. A forming cutter, which is required for this purpose, can also be equipped with exchangeable high-performance blades. In addition, such a cutter engages along the whole circumference in the material to be removed so that a high metal removal rate and therefore an efficient machining is possible. By means of the pointed-arch-shaped contour of the cutting teeth, a transition, which is advantageous for the flow, from the machined to the cast duct surface is produced at least in the area of a course of the duct wall which is concave in the flow direction.

In contrast, individually for each workpiece according to the direction of the respective core offset, a more or less pronounced edge is formed on the opposite duct sides with the convex course of the wall, on which edge the flow will separate. Such flow separations form a cross-sectional narrowing and therefore impair an optimal charge cycle. Particularly in the case of the inlet ports, separation-causing machining edges would reduce an optimal cylinder charge or impair an inlet flow which should be constantly good for all engines of a manufacture and thus reduce the engine output which can in fact be achieved by means of the internal-combustion engine or reduce the quality of the combustion.

It is an object of the invention to improve the cylinder head of the above-mentioned type such that the machining allowance in the area of the charge cycle ducts close to the valve can, on the one hand, be worked off without any offset by means of a forming cutter which is guided in a straight line but that nevertheless a surface course can be obtained also in the area of the convexly extending wall parts which is advantageous to the flow.

This and other objects have been achieved according to the present invention by providing a cast cylinder head for an internal-combustion engine, comprising a combustion-space-side boundary wall defining at least one circular valve opening, and a duct wall defining a charge cycle duct communicating with the at least one valve opening, an interior surface of the charge cycle duct being offset relative to a peripheral surface of the boundary wall defining the valve opening within a defined, maximally acceptable tolerance field, said duct wall defining a machining allowance which increases toward the valve opening and which, at the valve opening, corresponds in size to at least a maximally acceptable amount of offset, an area of the charge cycle duct proximate the opening being cuttingly machined on an interior side such that the interior surface of the charge cycle duct changes in each case without offset into the valve opening, wherein a compensating groove is provided proximate the machining allowance of the charge cycle duct in the cast crude condition, extending in the circumferential direction and having a flat V-shaped cross-section, flanks of said groove converging approximately in the center of the groove acutely with respect to a base of the groove, said flanks having a convexly shaped cross-section and being curved, the compensating groove being provided at least in the area of a convex interior wall of said charge cycle duct, the compensating groove extending above one of an upper edge of a recess for a valve seat ring and a valve seat in the valve opening a distance of approximately 20 to 30% of the inside diameter of the valve opening, the groove base being situated outside an ideal course of the interior surface so that not only is there no machining allowance in this area but the real interior surface of the charge cycle duct locally has an overmeasure with respect to said ideal course.

This and other objects have been achieved according to the present invention by providing a crude cast component to be finished into a cylinder head for an internal-combustion engine, comprising: a boundary wall defining a valve opening; and a duct wall having an interior surface defining a duct communicating with said valve opening, at least a portion of said interior surface being convexly curved proximate said valve opening along a longitudinal course of said duct, said interior surface of the duct wall defining a compensating groove proximate said valve opening, said compensating groove having a base extending circumferentially around at least a portion of said convexly curved portion, said compensating groove having a first flank extending convexly from said base toward said valve opening to define a machining allowance in said duct wall, said compensating groove having a second flank extending convexly from said base opposite said valve opening.

This and other objects have been achieved according to the present invention by providing a casting mold for forming a crude cast component to be finished into a cylinder head for an internal-combustion engine, comprising at least one negative mold part having spaces which define: a boundary wall defining a valve opening; and a duct wall having an interior surface defining a duct communicating with said valve opening, at least a portion of said interior surface being convexly curved proximate said valve opening along a longitudinal course of said duct, said interior surface of the duct wall defining a compensating groove proximate said valve opening, said compensating groove having a base extending circumferentially around at least a portion of said convexly curved portion, said compensating groove having a first flank extending convexly from said base toward said valve opening to define a machining allowance in said duct wall, said compensating groove having a second flank extending convexly from said base opposite said valve opening.

This and other objects have been achieved according to the present invention by providing a method of forming a cylinder head for an internal-combustion engine, comprising the step of casting a component including: a boundary wall defining a valve opening; and a duct wall having an interior surface defining a duct communicating with said valve opening, at least a portion of said interior surface being convexly curved proximate said valve opening along a longitudinal course of said duct, said interior surface of the duct wall defining a compensating groove proximate said valve opening, said compensating groove having a base extending circumferentially around at least a portion of said convexly curved portion, said compensating groove having a first flank extending convexly from said base toward said valve opening to define a machining allowance in said duct wall, said compensating groove having a second flank extending convexly from said base opposite said valve opening.

As the result of the compensating groove according to the invention, the machining allowance can be machined in a manner which is advantageous for the flow by means of a forming cutter of a pointed-arch-shaped contour which dips linearly into the valve opening. In the case of a casting core which is placed in the absolutely accurate position which happens relatively infrequently a slight impairment of the flow with respect to the best construction is caused which is, however, within the tolerance range and is accepted. However, instead the achievable duct contours in the case of a moderate to extreme core offset are much better than in the state of the art. The compensating groove according to the invention will in every case avoid a constriction of the duct at a critical point. Thus, while the machining of the charge cycle duct is simple, the invention achieves a low-loss flow and therefore a good cylinder charge.

The compensating groove can be produced virtually without additional costs during the casting operation. The casting cores for the charge cycle ducts must only be provided with a circumferential build-up which negatively corresponds to the groove shape.

The advantage of the invention is a simple, efficient and low-cost machining of the duct end with a simultaneous reduction of the variation of the flow losses in the charge cycle ducts. In particular, in the case of two-way valve engines, the so-called tumbling—a circulation flow of the gases flowing into the combustion space with an axis of rotation situated in the longitudinal direction of the engine—which reacts very sensitively to changes of the flow conditions, is reduced to an easily tolerable fluctuation range despite occurring manufacture-caused fluctuations, so that the tumbling values indicated by the engine designer can also be maintained by means of a simple machining. The selected intensity of the tumbling in an interaction with other combustion-relevant engine parameters is responsible for an orderly and specifically desired combustion sequence. An unacceptably pronounced and uncontrolled change of the tumbling disturbs the compromise selected for a certain engine layout and has a negative effect on the combustion sound and/or the exhaust gas values.

Other objects, advantages and novel features of the present invention will become apparent from the following detailed description of the invention when considered in conjunction with the accompanying drawings.

BRIEF DESCRIPTION OF THE DRAWINGS

FIGS. 5, 6 and 7 are each views of the details according to FIGS. 2, 3 and 4 after the cutting removal of the machining allowance as well as the formation of the close-to-the-wall inlet flow in the transition area.

DETAILED DESCRIPTION OF THE DRAWINGS

Figure 1:
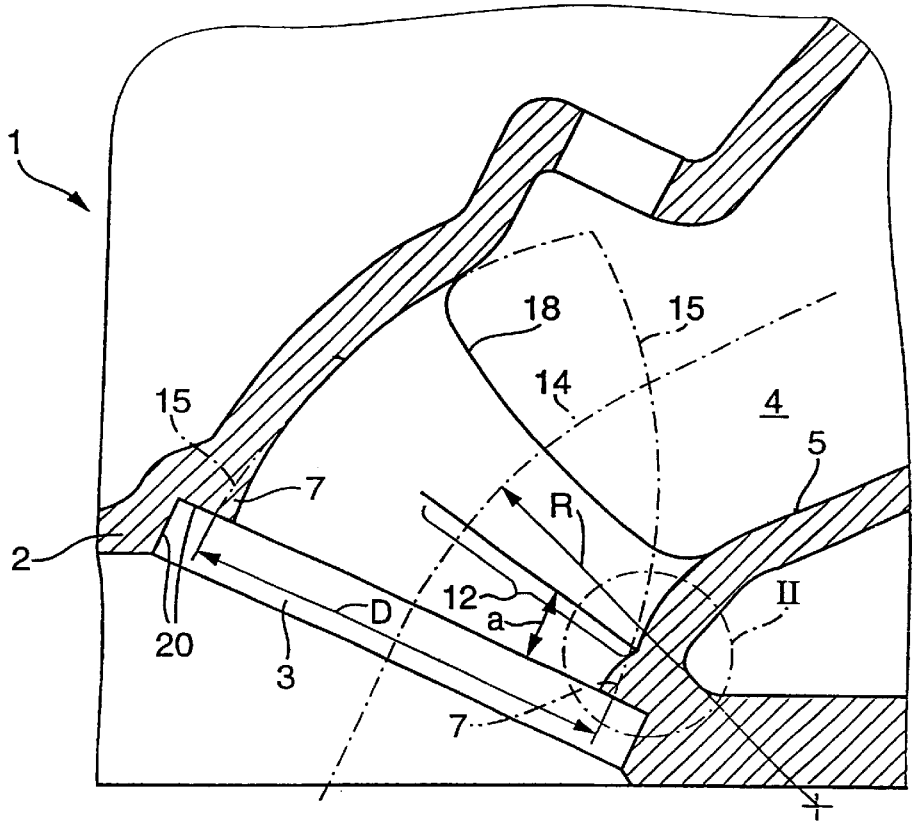
FIG. 1 is a partial sectional view of a cylinder head according to a preferred embodiment of the present invention in the area of an inlet port and of the valve opening, showing an offset-free position of the cast interior surface of the inlet port.

As a cutout, FIG. 1 illustrates a cast cylinder head 1 for an internal-combustion engine in the case of which a circular valve opening 3 is defined in the combustion-space-side boundary wall 2 as well as a charge cycle duct 4 which leads there, in the present case, an inlet port. The illustrated embodiment of the cylinder head has two valve openings per combustion space, which are situated in parallel behind one another, and has an inlet port which branches in a bifurcated manner with a separating rib 18 being provided between the valve openings.

The interior surface 5 of the charge cycle ducts 4 is molded by casting cores placed in the casting mold. Despite all care, these casting cores are subject to a certain positional tolerance with a maximally permissible tolerance field of, for example, ±1 mm in all directions. Accordingly, the interior duct surface also has an offset with respect to the position of the cuttingly machined valve opening 3, which offset is situated within this tolerance field and differs from one workpiece to the next, the valve opening 3 being machined onto the cylinder head as a reference contour in a precise position. In order to nevertheless be able to provide an offset-free transition of the interior surface into the pertaining valve opening by a cutting machining of the transition area, the charge cycle valves are provided in the cast crude condition in the area close to the opening with a machining allowance 7 which increases toward the valve opening. The amount of this allowance not only covers on all sides the maximally possible offset of the duct surface but, in addition, contains a certain machining overmeasure in order to permit a cutting machining in every case. Correspondingly, the above-mentioned machining allowance 7 on the valve opening in its amount corresponds at least to the above-mentioned maximally acceptable amount of offset, expediently to approximately 10% more than that.

On the one hand, this machining is to be carried out by means of a forming cutter which is guided in a straight line and has a pointed-arch-shaped contour 15, for which a simple machine tool and a forming cutter with a high service life and a high cutting performance can be used. On the other hand, a surface course which is advantageous with respect to the flow must also be achieved in the area of the convexly extending wall parts of the charge cycle duct; that is, an edge at the transition of the machined surface to the cast surface which causes a separation should be avoided also in the critical convex area.

In order to achieve this, according to the invention, a compensating groove 9 is provided in the area of the machining allowance 7 in the cast crude condition of the charge cycle ducts. It extends in the circumferential direction just above the valve opening and has a flat V-shaped cross-section. Relative to the flow direction in the charge cycle ducts, the compensating groove is provided at least in the area 12 of a convex to linear duct wall course. Since, in its cross-section, the separating rib, in the manner of a ship's bow, also has surfaces on its sides which are shaped convexly in the flow direction, a compensating groove is also provided in the area of the separating rib 18 in the case of two inlet valves per combustion space. In the circumferential area of a wall course which is concave in the flow direction and which geometrically forces a flow deflection, there is no danger that an edge which is disadvantageous to the flow will be formed during the machining of the duct because, on the one hand, the duct contour in this circumferential area is essentially determined by the contour 15 of the forming cutter which is adapted to the desired duct curvature and because, on the other hand, possible nevertheless forming transition edges do not disturb the flow. Since possible flow losses during the charge cycle mainly on the inlet side have a performance-influencing or rotation-influencing or tumble-influencing effect, at least the inlet ports of the cylinder head are provided with a compensating groove.

The compensating grooves can be advantageously used particularly on those cylinder heads in the case of which the charge cycle ducts are very curved in the area close to the valve; that is, their center line 14 is curved there with a curvature radius R which corresponds to approximately 1.0 to 2.5 times the inside diameter D of the valve opening 3. In the case of cylinder heads in which the charge cycle ducts change into the valve opening with a slight curvature, the edge which forms during the machining of the duct end from the direction of the valve opening is less disadvantageous to the flow. In the cases in which the charge cycle ducts extend steeply into the valve opening, the casting surface and the machined surface on the forming transition edge abut very flatly with one another so that the flow can follow such a surface course largely without any separation.

The optimal position, the course, the circumferential dimension and the cross-sectional shape of the compensating groove must be developed in the individual case by the designer corresponding to the respective constructively given environmental conditions of the cylinder head. However, irrespective thereof, the following may be stated in general: The distance (a) of the compensating groove above the upper edge of the recess 20 for a valve seat ring corresponds to approximately 20 to 30% of the inside diameter D of the valve opening. In the case of cylinder heads without any valve seat ring, the compensating groove can be arranged at a corresponding distance above the valve seat. The compensating groove extends at least in a rough approximation in a plane which extends approximately at a right angle with respect to the duct center line. In its cross-section, it is formed in the manner of a cushion-shaped constriction. The groove flanks 10 converge approximately in the center acutely with respect to the groove base 11 and have a convexly shaped cross-section and are curved without flow separation; that is, in their cross-section, the flanks of the compensating groove are curved at a curvature radius r or r' of at least approximately 18 mm or more.

The groove base 11 is situated outside the ideal course 21 of the interior surface so that in this area there is not only no machining allowance but the real interior surface of the charge cycle duct locally has an overmeasure with respect to the above-mentioned ideal course. The depth t of the groove measured to the duct tangent 17 is—at least at the circumferential point of the largest surface curvature in the flow direction—approximately equal to the maximal core offset.

In its cross-section, the compensating groove is constructed and arranged such that, in the case of an extreme position of the casting core, in which the circumferential part of the casting core with the compensating groove is closest to the center of the valve opening, in the fully engaged condition, the contour of the forming cutter extends through the groove base.

Figure 2:
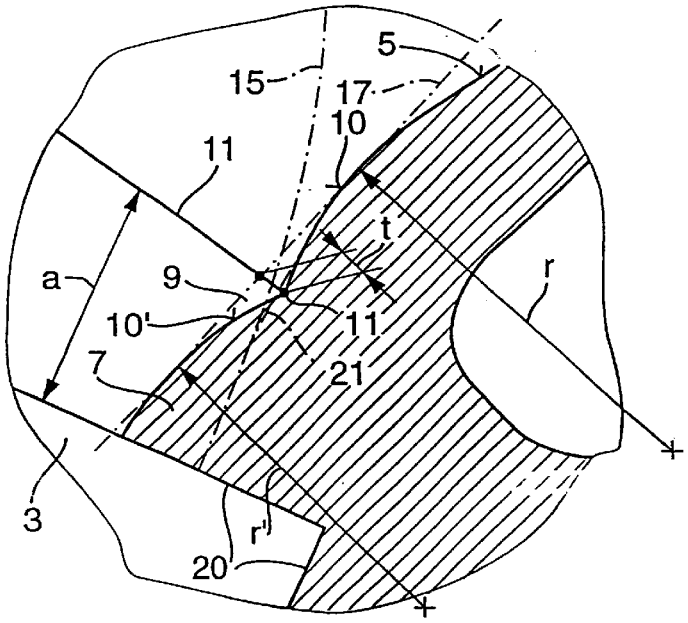
FIG. 2 is an enlarged view of the cross-section of the compensating groove (detail II from FIG. 1) before the cutting machining of the duct transition into the valve opening.
Figure 3:
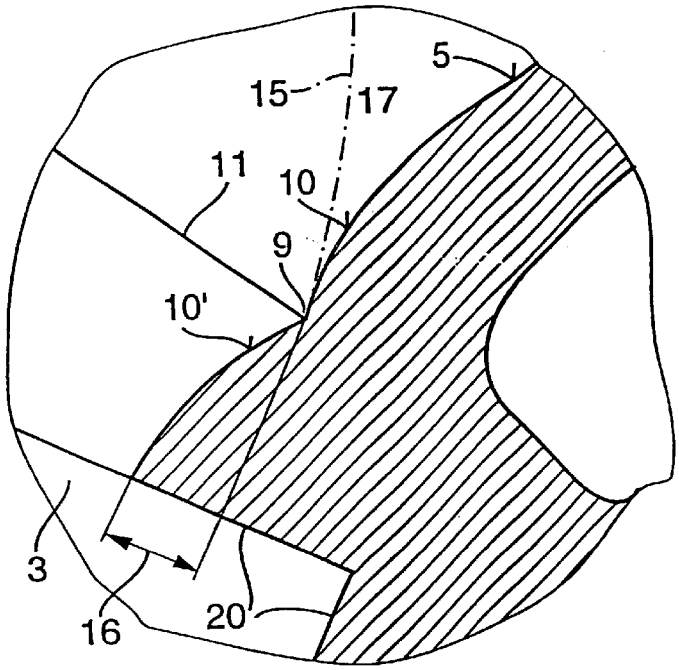
FIG. 3 is a view similar to FIG. 2, of the detail II in the case of an extreme offset of the interior surface in one direction, in the case of which the circumferential area provided with the compensating groove approaches the valve opening.
Figure 4:
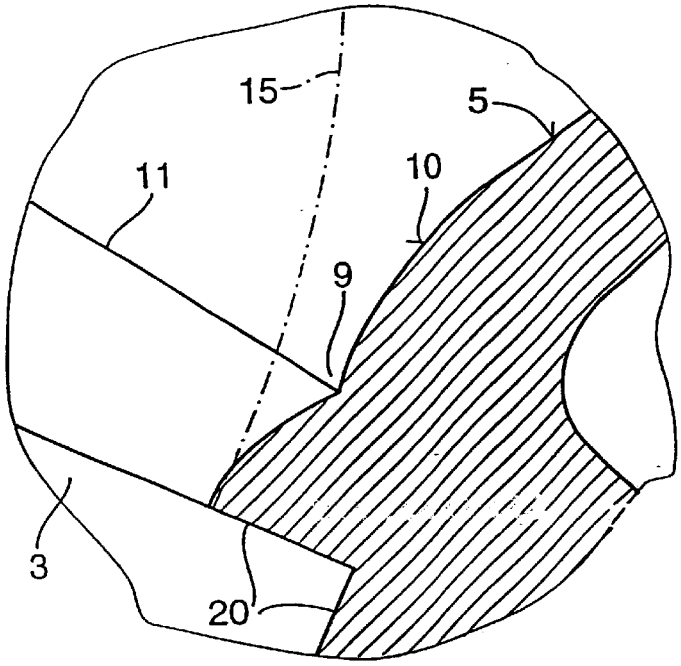
FIG. 4 is another view similar to FIG. 2, of the detail II in the case of an extreme offset of the interior surface in the other direction, in which the circumferential area provided with the compensating groove has moved away from the valve opening.

The practical success or advantage of the compensating groove 9 will be explained in the following by means of FIGS. 2 to 7, in which case, of the six figures, two are always considered together, in which, while the core offset is the same, the detail II is shown before and after the machining. Specifically, by means of three pairs of figures, the conditions "no core offset" are illustrated in FIGS. 2 and 5, "extreme core offset to the left" are illustrated in FIGS. 3 and 6; and "extreme core offset to the right" are illustrated in FIGS. 4 and 7. The desired position of the valve opening 3 is indicated by the machined recess 20 for the valve seat ring as well as by the indicated contour 15 of the profiling cutter for machining the duct transition from the direction of the valve opening, which in all three illustrated cases are arranged in the sane relative position. Only the interior surface of the charge cycle duct and of the compensating groove is disposed differently in relation to the valve opening.

In FIGS. 2 and 5, the condition of an ideal position of the casting core is assumed. FIG. 2 shows an ideal course 21 illustrated by a dash-dotted line without the compensating groove 9 according to the invention only as a comparison.

The line 21 leads tangentially into the base of the cutter contour 15. However, since with respect to this line, a machining overmeasure must also be considered, the duct surface which is in fact formed after the simple machining would have a slight edge.

In the case of the duct construction with the compensating groove 9 according to the invention, in the condition according to FIGS. 2 and 5, the forming cutter cuts relatively deeply into the machining allowance 7, but stays clearly back behind the groove base 11. As illustrated in FIG. 5, this results in a wide, cut surface 8 which ends shortly before the groove base 11. During the fine setting of the compensating groove with respect to the cross-sectional shape, the position and the course of the groove, it must, by means of the testing and varying of these criteria on the CAD-system, be taken into account that, in the case of a position of the casting core without any offset, approximately the machining pattern according to FIG. 5 is created. In the duct surface, a small groove of a low depth remains on the convex side which changes along a diagonal flank by way of an obtuse edge into the machined surface 8 which is indicated with hatching (circumferential flutes) extending in the circumferential direction. In the groove remaining after the machining, a small area 19 of a flow separation underneath the flow 13 close to the wall is formed which, however, does not result in any significant narrowing of the effective duct cross-section. Thus, in the case of the condition of a casting core with no offset, a slight and easily tolerable impairment of the flow is accepted. However, in contrast, the two other cases of an extreme core offset can clearly be improved with respect to their disturbing influence on the flow close to the wall in comparison to the state of the art, as illustrated by the following description.

FIGS. 3 and 6 illustrate the condition of an extreme core offset to the left, that is, there is an extreme offset of the casting core with the circumferential part forming the compensating groove toward the valve opening. Because of a corresponding optimizing of the position, the cross-sectional shape and the course of the compensating groove according to the invention, the forming cutter 15 in this condition cuts the material below the opening-side and therefore lower flank surface 10' completely away so that the machining surface 8' at the point of the former groove base 11 changes tangentially into the upper groove flank 10. In the case of this condition of an extreme core offset, no steps, edges or grooves are therefore formed—at least at the circumferential point of the inlet port illustrated on the right in FIG. 6—which could impair the flow 13 close to the wall. Despite the considerable core offset and the simple machining, the flow 13 close to the wall is therefore not disturbed.

In the case of an extreme core offset in the opposite direction according to FIGS. 4 and 7, the circumferential area of the compensating groove has moved particularly far away from the valve opening. In this condition, the overmeasure of material in the area of the compensating groove is cut only very little during the cutting machining of the duct end so that a very narrow strip of a machining surface 8" is formed there. In this condition, the compensating groove and particularly its lower flank 10' are almost completely retained so that, in the circumferential area of the compensating groove, this compensating groove itself essentially determines the flow characteristic of the flow 13 close to the wall. A small area 19 of a flow separation is formed only at the lowest point of the compensating groove which, however, does not significantly impair the flow. In addition, another small separation area is formed in the flow direction behind the edge at the transition to the cut surface 8" and is also negligible.

In the case of all permissible offsets of the casting core—whether they are large or small, on the left or on the right—, approximately identically good flow conditions therefore exist in the charge cycle ducts as the result of the compensating groove. In this case, it is mainly important that the variation of the flow losses is low over the whole field of the possible variants of core positions and definitely less than when a machining takes place without the compensating groove.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A cast cylinder head for an internal-combustion engine, comprising a combustion-space-side boundary wall defining at least one circular valve opening, and a duct wall defining a charge cycle duct communicating with the at least one valve opening, an interior surface of the charge cycle duct being offset relative to a peripheral surface of the boundary wall defining the valve opening within a defined, maximally acceptable tolerance field, said duct wall defining a machining allowance which increases toward the valve opening and which, at the valve opening, corresponds in size to at least a maximally acceptable amount of offset, an area of the charge cycle duct proximate the opening being cuttingly machined on an interior side such that the interior surface of the charge cycle duct changes in each case without offset into the valve opening, wherein a compensating groove is provided proximate the machining allowance of the charge cycle duct in the cast crude condition, extending in the circumferential direction and having a flat V-shaped cross-section, flanks of said groove converging approximately in the center of the groove acutely with respect to a base of the groove, said flanks having a convexly shaped cross-section and being curved, the compensating groove being provided at least in the area of a convex interior wall of said charge cycle duct, the compensating groove extending above one of an upper edge of a recess for a valve seat ring and a valve seat in the valve opening a distance of approximately 20 to 30% of the inside diameter of the valve opening, the groove base being situated outside an ideal course of the interior surface so that not only is there no machining allowance in this area but the real interior surface of the charge cycle duct locally has an overmeasure with respect to said ideal course.

2. A cylinder head according to claim 1, wherein the compensating groove extends at least in a rough approximation in a plane which extends approximately at a right angle with respect to a center line of said duct.

3. A cylinder head according to claim 1, a cross-section of the compensating groove is shaped as a cushion-shaped constriction.

4. A cylinder head according to claim 1, wherein the compensating groove is constructed and arranged such that, in the case of an extreme position of the casting core in which the circumferential part of the casting core with the compensating groove is closest to the valve opening, the contour of the forming cutter extends in the fully engaged condition through the groove base.

5. A cylinder head according to claim 1, wherein a depth of the compensating groove measured to a tangent of the duct is approximately equal to a maximal core offset.

6. A cylinder head according to claim 1, wherein the flanks of the compensating groove in their cross-section are curved at a radius of curvature of at least approximately 18 mm or more.

7. A cylinder head according to claim 1, wherein at least the inlet ports of the cylinder head are provided with a compensating groove.

8. A cylinder head according to claim 1, wherein the charge cycle ducts 4 are considerably curved in an area close to the valve opening and have a center line with a radius of curvature which corresponds to approximately 1.0 to 2.5 times an inside diameter of the valve opening.

9. A cylinder head according to claim 1, wherein the cylinder head define at least two inlet valves per combustion space, and a separating rib is provided between adjacent of the valve openings of each combustion space, further comprising a compensating groove being provided proximate said separating rib.

10. A crude cast component to be finished into a cylinder head for an internal-combustion engine, comprising:

a boundary wall defining a valve opening; and a duct wall having an interior surface defining a duct communicating with said valve opening, at least a portion of said interior surface being convexly curved proximate said valve opening along a longitudinal course of said duct, said interior surface of the duct wall defining a compensating groove proximate said valve opening, said compensating groove having a base extending circumferentially around at least a portion of said convexly curved portion, said compensating groove having a first flank extending convexly from said base toward said valve opening to define a machining allowance in said duct wall, said compensating groove having a second flank extending convexly from said base opposite said valve opening.

11. A crude cast component according to claim 10, wherein said valve opening has an inside diameter and a valve seat area, said base of the compensating groove being spaced at a distance within the range of 20% to 30% of said inside diameter from said valve seat area.

12. A crude cast component according to claim 10, wherein said base of the compensating groove extends in a plane which is approximately normal to a center line of said duct.

13. A method of forming a cylinder head for an internal-combustion engine, comprising the step of casting a component including:

a boundary wall defining a valve opening; and a duct wall having an interior surface defining a duct communicating with said valve opening, at least a portion of said interior surface being convexly curved proximate said valve opening along a longitudinal course of said duct, said interior surface of the duct wall defining a compensating groove proximate said valve opening, said compensating groove having a base extending circumferentially around at least a portion of said convexly curved portion, said compensating groove having a first flank extending convexly from said base toward said valve opening to define a machining allowance in said duct wall, said compensating groove having a second flank extending convexly from said base opposite said valve opening.

14. A method according to claim 13, further comprising the step of subsequently cutting said cast component at said machining allowance to define a final charge cycle duct in said component.

* * * * *